US006126017A

United States Patent [19]

Hours

[11] Patent Number: 6,126,017

[45] Date of Patent: Oct. 3, 2000

[54] DEVICE AND METHOD FOR SORTING OBJECTS USING BUFFER RECEPTACLES AT SORTING OUTLETS

[75] Inventor: Patrick Hours, Saint-Feray, France

[73] Assignee: Mannesmann Dematic Postal Automation S.A., Gentilly Cedex, France

[21] Appl. No.: 08/709,094

[22] Filed: Sep. 6, 1996

[30] Foreign Application Priority Data

Sep. 8, 1995 [FR] France ..... 95 10549

[51] Int. Cl.[7] ..... B07C 9/00

[52] U.S. Cl. ..... 209/698; 209/706; 209/900; 209/911; 198/370.03; 198/704

[58] Field of Search ..... 209/698, 706, 209/900, 912, 911; 198/369.7, 370.01, 370.03, 701, 703, 704

[56] References Cited

U.S. PATENT DOCUMENTS

| | | | |
|---|---|---|---|
| 4,509,635 | 4/1985 | Emsley et al. | 198/370.03 |
| 4,892,185 | 1/1990 | Guardiola | 198/704 X |
| 4,895,242 | 1/1990 | Michael | 209/900 X |
| 5,538,140 | 7/1996 | Guenther et al. | 209/900 X |
| 5,551,576 | 9/1996 | Impartico | 209/706 X |

FOREIGN PATENT DOCUMENTS

| | | | |
|---|---|---|---|
| 0095723A3 | 12/1983 | European Pat. Off. . | |
| 0339337A2 | 11/1989 | European Pat. Off. . | |
| 1634599 | 3/1991 | U.S.S.R. | 198/704 |
| 638723 | 4/1949 | United Kingdom | 198/704 |

*Primary Examiner*—Tuan N. Nguyen
*Attorney, Agent, or Firm*—Sughrue, Mion, Zinn, Macpeak & Seas, PLLC

[57] ABSTRACT

The device for sorting objects, for example mail items, includes a conveyor (1) that directs the objects to be sorted to sorting output receptacles (7) associated with corresponding sorting outputs and in which the sorted objects are stored. A buffer receptacle (11) is provided at each sorting output. Each buffer receptacle (11) has a retractable bottom (12) and temporarily stores sorted objects before they are transferred into a sorting output receptacle and/or while that sorting output receptacle is replaced by an empty receptacle. Because of these buffer receptacles, the throughput of the sorting device may remain constant while sorting output receptacles are replaced.

6 Claims, 2 Drawing Sheets

DEVICE AND METHOD FOR SORTING OBJECTS USING BUFFER RECEPTACLES AT SORTING OUTLETS

BACKGROUND OF THE INVENTION

1. Field of the Invention

The invention concerns a device for sorting objects, comprising a conveyor that directs the objects to be sorted to sorting output receptacles associated with corresponding sorting outputs and in which the sorted objects are stored.

A device of this kind is more particularly intended for sorting flat objects such as mail items of the envelope or like kind.

2. Related Art

With a mail item sorting device of the kind indicated above, when a sorting output receptacle is full, it is necessary to stop directing the mail items to be sorted towards the sorting output corresponding to that receptacle temporarily, i.e. for the time needed to remove the full receptacle and to replace it with an empty receptacle. During this time, a number of mail items to be sorted that are to be directed to this sorting output are recycled on the conveyor. The result is a non-negligible reduction in the throughput of the sorting device, and even temporary saturation of the device if the number of mail items recycled becomes too large. This situation is even more critical on passing from one sorting scheme to another sorting scheme because in this situation all of the sorting output receptacles must be replaced by empty receptacles. A sorting scheme corresponds to a precise allocation of the sorting outputs of the conveyor to mail item sorting addresses. The result is then unavailability of all of the sorting outputs of the conveyor for the time needed to replace all of the sorting output receptacles.

SUMMARY OF THE INVENTION

An aim of the invention is to solve the above problem.

In accordance with the invention, the device for sorting objects, for example mail items, including a conveyor that directs the objects to be sorted to sorting output receptacles associated with corresponding sorting outputs and in which the sorted objects are stored, includes a buffer receptacle at each sorting output, each buffer receptacle at a sorting output being adapted to store sorted objects temporarily and, on command, to release said temporarily stored objects into the corresponding sorting output receptacle. In this way, knowing how full the sorting output receptacles or the buffer receptacles are, the rate at which objects advance on the conveyor, and the time needed to replace a sorting output receptacle that is full of objects with an empty receptacle, it is a simple matter to maintain the throughput of the sorting device constant while replacing one or more sorting receptacles by choosing an adequate capacity for the buffer receptacles.

The invention includes a method of sorting objects in which the supervisory means is commanded to keep the retractable bottom of each buffer receptacle normally closed in order to store sorted objects temporarily therein and to open the retractable bottom of a buffer receptacle when it is nearly full in order to transfer the temporarily stored objects from said buffer receptacle to the corresponding sorting output receptacle. This stores objects more efficiently in the sorting output receptacles, especially in the case of flat objects such as mail items, because they are transferred as a stack.

BRIEF DESCRIPTION OF THE INVENTION

An embodiment of the invention is described in more detail hereinafter, with reference to the drawing figures described briefly below:

DETAILED DESCRIPTION OF THE INVENTION

Figure 1:
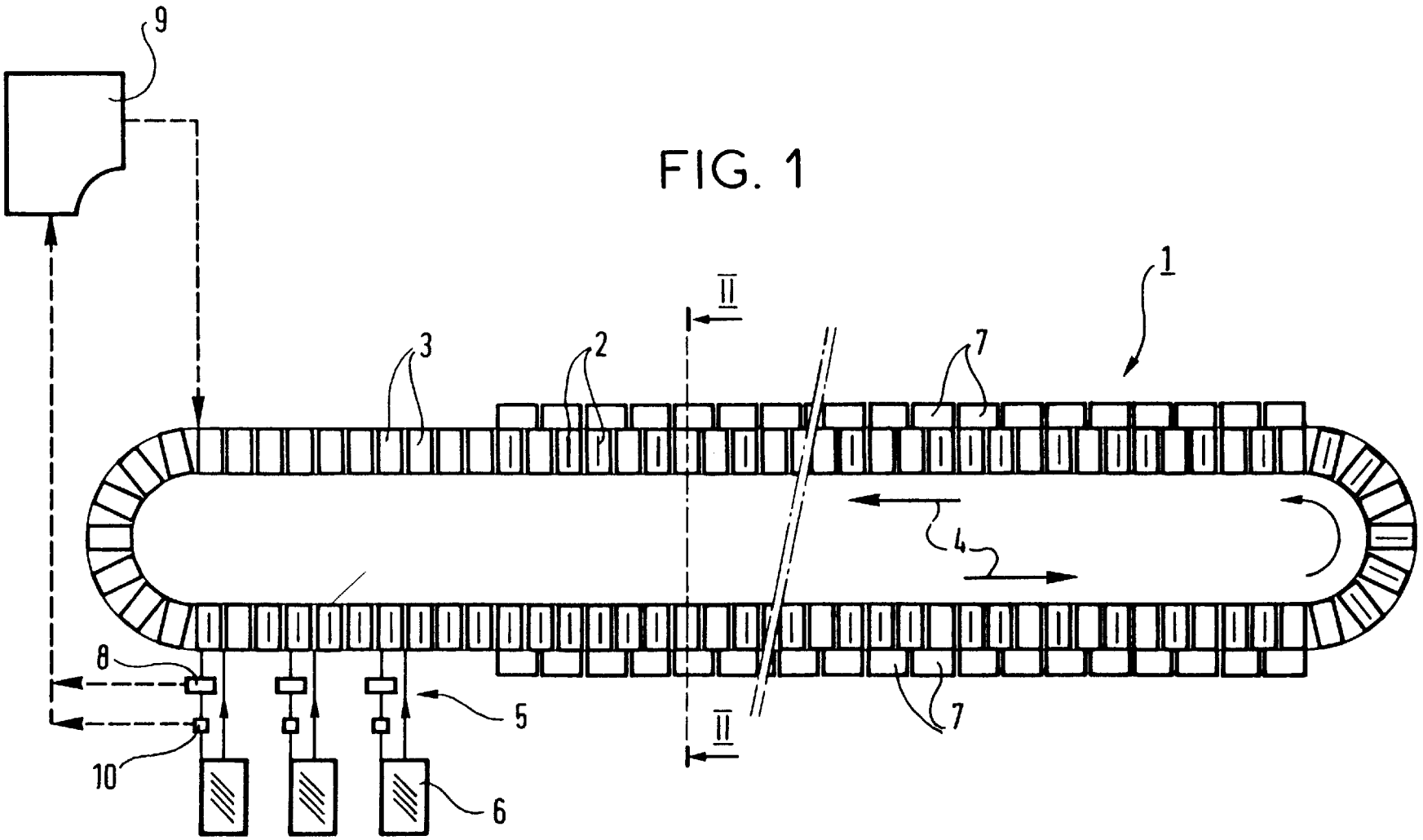
FIG. 1 is a diagrammatic representation of a mail item sorting device of the invention that includes sorting output receptacles and buffer receptacles.

Referring to FIG. 1, the mail item sorting device includes a conveyor 1 that automatically directs mail items 2 to be sorted to sorting outputs.

The conveyor is an endless chain carrying a series of buckets 3 which travel round a loop in the direction indicated by the arrows 4.

Each bucket carries a single mail item that is fed into it at an input to the conveyor where there is a feed unit 5. FIG. 1 shows three such feed units 5. Each feed unit 5 generally includes an automatic unstacker adapted to separate a stack of mail items 6 waiting at the corresponding input of the conveyor.

A sorting output receptacle 7 is associated with each sorting output. FIG. 1 shows a plurality of such output receptacles. A mail item sorting device includes several dozen sorting outputs and therefore several dozen corresponding receptacles 7 disposed along the conveyor, in this example on both sides of the loop.

At each feed unit 5 there is a device 8 for reading a sorting address on each mail item separated out at the input to the conveyor by automatic recognition of characters or bar codes, for example. A sorting output and therefore a sorting output receptacle 7 are assigned to each sorting address and a microcomputer type supervisory system 9 is connected to the device 8 and controls the conveyor 1 and the buckets 3 so that each bucket 3 containing a mail item releases that mail item at the sorting output corresponding to the sorting address retrieved for that mail item so that the mail item is stored in the sorting output receptacle corresponding to said sorting output.

At each feed unit 5 there is also a device 10 for measuring the thickness of each mail item fed onto the conveyor. This thickness measuring device is entirely conventional. The supervisory system 9 is connected to the device 10 to monitor, if necessary by predicting, how near to full the sorting output receptacles 7 are, by totalling the thicknesses of the mail items stored in each sorting output receptacle.

Figure 2:
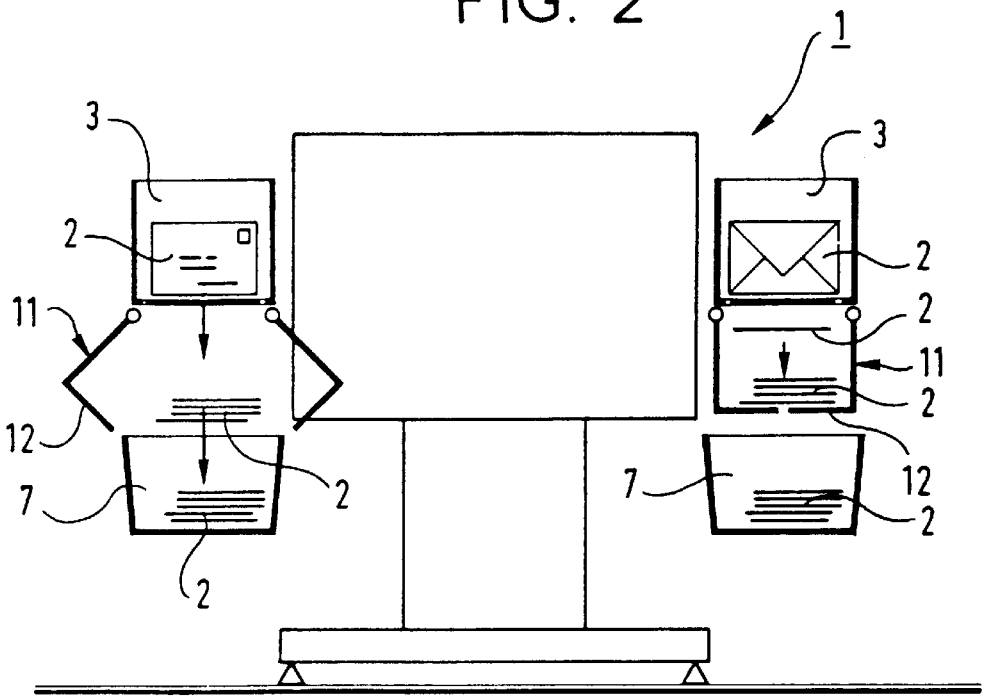
FIGS. 2 and 3 show the arrangement of the sorting output receptacles and the buffer receptacles in more detail during operation of the device of the invention.

FIG. 2 is a diagrammatic view in section taken along the line II—II in FIG. 1, showing the conveyor 1 with two buckets 3 on respective opposite sides of the loop and each containing a mail item 2 in the form of an envelope. Each of the two buckets 3 is positioned at a sorting output above two respective sorting output receptacles 7 each corresponding to one sorting output and in which sorted mail items 2 are stored. For example, each receptacle 7 is normally placed on a support (not shown) from which it is removed and replaced (possibly automatically) by another receptacle 7', for example an empty receptacle.

The invention provides a buffer receptacle 11 at each sorting output. These buffer stores (11) are mounted on a structure supporting the conveyor 1 and the bases for the receptacles 7. In FIG. 2, each buffer receptacle 11 is placed under a bucket 3 and over a sorting output receptacle 7. Each buffer receptacle 11 is adapted to store at least temporarily a certain quantity of mail items fed to the sorting output at which it is located. It has a retractable bottom 12, for example a two-part hinged bottom adapted to be closed for storage as mentioned above and as can be seen in the righthand part of FIG. 2 or opened to release mail items into the corresponding sorting output receptacle 7, as shown on the left in FIG. 2.

Each buffer receptacle 11 is preferably vertically aligned with the corresponding sorting output receptacle 7 so that mail items are transferred from the buffer store to the corresponding sorting output store by gravity, which helps to simplify the layout of the conveyor.

To sort mail items with a device of this kind, the supervisory system 9 is programmed to monitor how near to full each buffer receptacle 11 is on the basis of information supplied by the units 8 and 10. The supervisory system retains the buffer receptacles 11 in a normally closed position as shown on the right in FIG. 2. The mail items directed to a sorting output are first stored temporarily in the buffer receptacle at that sorting output. On detecting that the buffer receptacle in question is nearly full, the supervisory system commands the opening of the bottom of the buffer receptacle to release the temporarily stored mail items into the corresponding sorting output receptacle, as shown on the left in FIG. 2. As the mail items are stored flat, both in the buffer receptacle 11 and in the sorting output receptacle 7, the mail items are stored more efficiently in the receptacle 7 by transferring them as a stack rather than by transferring them individually. Note that each sorting output receptacle 7 filled with mail items can be replaced by an empty receptacle 7' while the corresponding buffer receptacle 11 is filling, without affecting the throughput of the sorting device.

Figure 3:
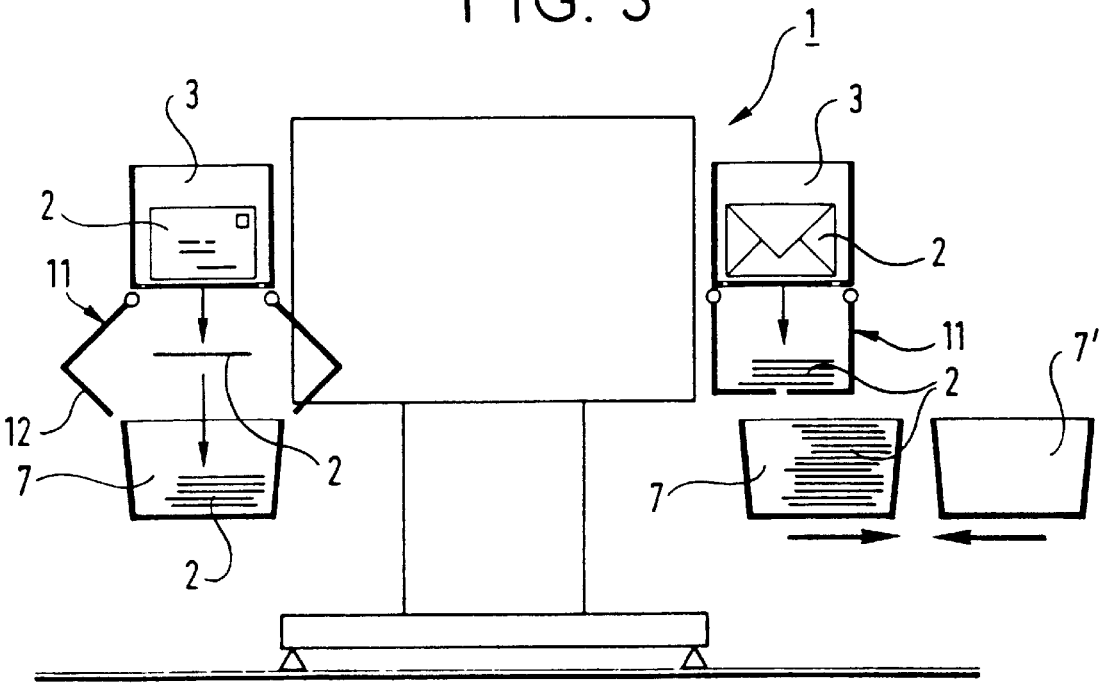

FIG. 3 shows a different embodiment in diagrammatic section taken along the line II—II of the mail item sorting device of the invention in which the supervisory system 9 is programmed to monitor how near to full each sorting output receptacle 7 is on the basis of information supplied by the units 8 and 10. The supervisory system keeps the buffer receptacles 11 in a normally open position as shown on the left in FIG. 3. The mail items directed to a sorting output therefore pass through the buffer receptacle at that sorting output without being stored therein. On detecting that a sorting output receptacle is nearly full, the supervisory system commands the closing of the bottom 12 of the corresponding buffer receptacle so that the mail items directed to that sorting output are temporarily stored in the buffer receptacle, as shown on the right in FIG. 3. During the temporary storage of mail items in the buffer receptacle the corresponding sorting output receptacle 7 filled with mail items is replaced with an empty receptacle 7', without reducing the throughput of the conveyor.

The layout of the mail item sorting device with buffer receptacles 11 in accordance with the invention enables a change of sorting scheme without stopping the conveyor or reducing its throughput. It is sufficient for the supervisory system to command the opening or the closing of the buffer receptacles 11 so that the last items of a current sorting scheme are stored directly in the sorting output receptacles 7 and the first mail items of the next sorting scheme are stored in the buffer receptacles 11. On completion of the first sorting scheme, the sorting output receptacles 7 are replaced with empty receptacles and the buffer receptacles are then off loaded into these empty receptacles.

What is claimed is:

1. A device for sorting objects, including a conveyor (1) that directs the objects to be sorted to sorting output receptacles (7) associated with corresponding sorting outputs and in which the sorted objects are stored, and buffer receptacles (11) provided, respectively, at each of the sorting outputs, and fixed in position relative to corresponding ones of the sorting output receptacles (7), each of said buffer receptacles storing sorted objects temporarily and, on command, releasing the temporarily sorted objects into the corresponding ones of the sorting output receptacles (7);

wherein each one of the buffer receptacles (11) includes a retractable bottom (12) and is disposed over the corresponding one of the sorting output receptacles (7);

means (5) for feeding the objects to be sorted onto the conveyor (1);

means (8, 10) for outputting signals indicative of a dimension of each one of the objects fed onto the conveyor and the sorting output to which the objects must be directed; and means (9) for monitoring how near to full the sorting output receptacles (7) and the buffer receptacles (11) are based on an output of said outputting means (8, 10), and for commanding the opening or the closing of the retractable bottom (12) of each one of the buffer receptacles (11) according to how near to full said buffer receptacles (11) or the corresponding sorting output receptacles (7) are.

2. The device as claimed in claim 1, wherein said monitoring and commanding means (9) keeps the retractable bottom (12) of each one of the buffer receptacles (11) normally open and closes the retractable bottom (12) of one of the buffer receptacles (11) when a corresponding one of the sorting output receptacles (7) is nearly full.

3. The device as claimed in claim 1, wherein said monitoring and commanding means (9) keeps the retractable bottom (12) of each one of the buffer receptacles (11) normally closed in order to store sorted objects (2) temporarily therein and opens the retractable bottom (12) of one of the buffer receptacles (11) when said one of the buffer receptacles (11) is nearly full in order to transfer the temporarily stored objects from said one of the buffer receptacles (11) to a corresponding one of the sorting output receptacles (7).

4. A method of sorting objects using a device including a conveyor (1) that directs the objects to be sorted to sorting output receptacles (7) associated with corresponding sorting outputs and in which the sorted objects are stored, and buffer receptacles (11) provided, respectively, at each of the sorting outputs, and fixed in position relative to corresponding ones of the sorting output receptacles (7), said method comprising:

storing objects temporarily in the buffer receptacles (11);

releasing the temporarily stored objects on command into the corresponding ones of the sorting output receptacles (7);

feeding the objects to be sorted onto the conveyor (1);

outputting signals indicative of a dimension of each one of the objects fed onto the conveyor and the sorting output to which the objects must be directed; and monitoring how near to full the sorting output receptacles (7) and the buffer receptacles (11) are based on the signals output in said outputting step, and commanding the opening or the closing of a retractable bottom (12) of each one of the buffer receptacles (11) according to how near to full said buffer receptacles (11) or the corresponding sorting output receptacles (7) are.

5. The method claimed in claim 4, comprising keeping the retractable bottom (12) of each one of the buffer receptacles (11) normally open and closing the retractable bottom (12) of one of the buffer receptacles (11) when a corresponding one of the sorting output receptacles (7) is nearly full.

6. The method claimed in claim 4, comprising keeping the retractable bottom (12) of each one of the buffer receptacles (11) normally closed in order to store sorted objects (2) temporarily therein and opening the retractable bottom (12) of one of the buffer receptacles (11) when the one of the buffer receptacles (11) is nearly full in order to transfer the temporarily stored objects from the one of the buffer receptacles (11) to a corresponding one of the sorting output receptacles (7).

* * * * *